United States Patent [19]

Tyssee

[11] 4,013,524

[45] Mar. 22, 1977

[54] ELECTROLYTIC CARBOXYLATION AND DIMERIZATION OF OLEFINS

[75] Inventor: Donald Armon Tyssee, St. Louis, Mo.

[73] Assignee: Monsanto Company, St. Louis, Mo.

[22] Filed: Dec. 21, 1972

[21] Appl. No.: 317,345

[52] U.S. Cl. ..... 204/59 R; 204/72

[51] Int. Cl.[2] ..... C25B 3/00; C25B 3/10

[58] Field of Search ..... 204/59 R, 72, 73

[56] References Cited

UNITED STATES PATENTS

| | | | |
|---|---|---|---|
| 3,032,489 | 5/1962 | Loveland | 204/73 R |
| 3,193,478 | 7/1965 | Baizer | 204/73 R |
| 3,344,045 | 9/1967 | Neikam | 204/59 R |
| 3,344,046 | 9/1967 | Neikam | 204/59 R |
| 3,616,322 | 10/1971 | Seko et al. | 204/73 A |

*Primary Examiner*—F.C. Edmundson

*Attorney, Agent, or Firm*—Joseph D. Kennedy; John D. Upham

[57] ABSTRACT

α,β-Olefinic nitriles, esters and amides are electrolytically carboxylated and dimerized.

14 Claims, No Drawings

ELECTROLYTIC CARBOXYLATION AND DIMERIZATION OF OLEFINS

BACKGROUND OF THE INVENTION

The present invention relates to the electrolytic carboxylation and dimerization of olefinic nitriles, esters and amides.

Carboxylic esters and derivatives are well known industrial chemicals, having such diverse uses as plasticizers, monomers for the preparation of polyesters by interaction with glycols, etc. It has previously been known that some types of unsaturated compounds are subject to reduction at the cathode and dimerization. It has also been known that when relatively stable reduction intermediates are obtained because of substituents on the olefinic group, as in the case of benzalacetone, the intermediates will react with carbon dioxide to form carboxyl compounds; (see Wawzonek et al. J. Electrochem. Soc., Vol III, pages 324 to 328, (1964). It has also been known that acrylonitrile can be dicarboxylated, although apparently in very poor yield, by electrolysis under specified conditions in dimethyl formamide., see Tsutsumi et al, Electrochemical Carboxylation of Olefins, abstract of paper presented at Division of Petroleum Chemistry, American Chemical Society, Chicago Meeting, September 13–18, 1970.

SUMMARY OF THE INVENTION

The present invention involves electrolytic reduction of nitriles, esters or amides of aliphatic $\alpha,\beta$-olefinic acids in the presence of carbon dioxide to effect carboxylation and dimerization thereof, and recovering dimerized carboxyl derivatives. The reaction is directed toward the production of the dimer products by control of concentrations so as to have an excess of the olefinic reactants present, along with, or alternatively, controlling cathode potential. The invention is also directed to a hexacarboxylated butane, which is useful in various applications, such as a detergent builder.

DETAILED DESCRIPTION OF THE INVENTION

The course of reaction of the present invention can be illustrated:

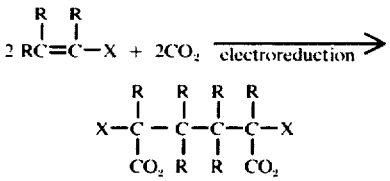

in which the Rs are individually selected from hydrogen, monovalent aliphatic radicals or X, and X is selected from

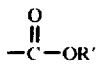

and

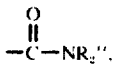

in which R′ is a monovalent organic radical and the R″s are individually selected from monovalent organic radicals and hydrogen.

The degree to which dimerization occurs is influenced by competitive reactions between the starting olefin and its reduction products, carbon dioxide, and any proton donors which may be present in the reaction mixture. Hence the process is subject to direction to some extent, by regulation of the olefin and carbon dioxide concentrations. The rate at which the reduction products are further reduced is also influential, and may provide an additional control. For example, if the reaction shows a single electron uptake polargraphically in the presence of $CO_2$ at given potential, the potential can be controlled to provide for only the first electron uptake, and dimer products will generally be obtained in preference to products resulting from addition of a second electron to the initial reduction intermediate. Those olefins characterized by a single electron uptake can be readily determined polargraphically in the presence of $CO_2$, exhibiting a single wave rather than two waves.

The waves referred to are cathodic waves, with the half-wave potentials, being the potential of the inflection point of a current potential diagram obtained under described polarographic conditions. The potentials are ordinarily negative potentials, and numerical values herein are with respect to a saturated calomel reference electrode. The electrolytic reaction which occurs is reduction, the addition of one or two electrons. If the first electron adds at a particular potential and the second electron at a numerically larger (more negative) potential, the current potential diagram then has two inflection points and would be referred to as having two waves.

The carboxyl compounds produced in the present invention can be recovered in the form of free acid, esters or salts. With a fair amount of proton donor in the electrolysis, the product is generally in the form of the free acid, and can be separated by extraction, e.g. with ether, and evaporation of the extracting medium. If the product is in the form of a salt, it can be converted to the free acid by mild acidification, e.g., with dilute mineral acid, and isolated as such. Some products may exhibit a tendency to decarboxylation upon use of stringent conditions such as high temperatures and concentrated strong acids, so care should be exercised in such cases to avoid decarboxylation. In the procedures in which nitriles are employed, it will ordinarily be desirable to avoid conditions known to result in hydrolysis of the nitrile group, such as excessively acid or basic conditions with elevated temperatures. When a nitrile is the starting material, it will generally be desirable to retain the cyano group in the product and to obtain a $\beta$-cyanocarboxylic acid, rather than hydrolyze the nitrile group, as such products are less readily available from other sources than are the corresponding succinic acids which are obtained by the hydrolysis. However the present procedure is still to be considered operative even though hydrolysis does result in the production of a succinic acid. With respect to the olefinic esters and amides, it will be noted that such groups are also subject to hydrolysis and the foregoing also applies to reactions involving such compounds, although conversion from ester to free acid form may often be contemplated for a particular product. If it is desired, the carboxylated products can be converted to ester form by usual esterification procedures, e.g., by treatment with methyl iodide or dimethyl sulfate. The ester forms are amenable to separation by extraction procedures. The products may at times be found in salt form because of the present of salts in the electrolysis, but, in any event, can be converted to salt form by treatment with bases, and the salts can frequently be isolated by aqueous solvent extraction.

The activated olefinic reactants employed herein will often be largely hydrocarbon in character, i.e., be alkenyl carboxylates, nitriles or amides, and the resulting carboxylates can be employed as detergent builders or as monomers for production of polyester resins (by reaction with glycols etc.), or for production of polyamide resins. However it may at times be desirable to have various other groups present in the molecules, and the present process can be effected with various other substituents present in the olefinic reactants, including even such electron releasing heteroatoms as O, N, P and S bearing various substituents and attached to one of the olefinic carbon atoms. Of course such heteroatoms at more remote locations in the olefinic reactant will have little effect and reactants having such substituents can suitably be employed.

Alpha, beta-olefinic reactants to which the present invention is applicable include for example, acrylonitrile, methacrylonitrile, crotonitrile, pentenenitrile, 2-ethylidenehexanenitrile, β-carbethoxyacrylonitrile, β-methoxyacrylonitrile, fumaronitrile, methyl acrylate, ethyl acrylate, ethyl crotonate, phenylethyl acrylate, ethyl 2-pentenoate, pentyl fumarate, diethyl maleate, ethyl 3-methoxyacrylate, acrylamide, N,N-diethylcrotonamide, N,N-diethylmethacrylamide, N,N-diphenylacrylamide, etc. The reaction results in production of a product corresponding to a dimer of the reactant but with a carboxyl group substituted on an olefinic carbon atom, generally that alpha to a nitrile, carbalkoxy, or amido group of the reactant, and with the olefinic bond becoming saturated. As discussed herein, the nitrile, carbalkoxy, or amido groups can also be reacted, if desired, to form other derivatives.

As discussed herein, some olefinic reactants are characterized by the fact that they give two polargraphic waves, and can be directed toward carboxylative dimerization by control of cathode potential. The fumarates and maleates are examples of such olefins, e.g. dimethyl maleate, dimethyl fumarate and ethyl methyl maleate. The cathode control can be effected by potentiostatic means with respect to a reference electrode, or it can be achieved by providing sufficient of the olefinic reactant so that the cathode does not reach a sufficiently negative potential to add a second electron to the reactant. This can ordinarily be done by simply adding a large excess of the olefinic reactant initially and maintaining an excess. It can also be done by starting with a small charge of olefinic reactant and adding additional reactant at a rate at least equal to that at which it is reacted, i.e., at a rate sufficient to maintain a constant current with a particular applied potential.

The present process is believed to involve reduction of the olefinic reactant and subsequent reaction with carbon dioxide. The types of activated olefins utilized herein are known to be subject to reduction to form radical anions as transitory intermediates. The intermediates which are formed are relatively short-lived and differ in this respect from other radical anions which are reactable with carbon dioxide. For example, phenyl or other aromatic substituents on an olefinic carbon atom are known to stabilize radical anions obtained by reduction of such olefins. In the present process, it has been found unnecessary to have long-lived reduction intermediates, and aromatic substituents are not necessary in order to obtain carboxylation with the type of activated olefins employed herein. Aromatic substituents on carbon atoms other than those of the olefinic group will not in general, affect the aliphatic character of the olefinic reactants in that the intermediates obtained can still be very short-lived and transitory, i.e., the aliphatic olefinic acid derivatives employed herein will not have any aryl groups in position to form conjugated double bond systems with the olefinic group.

The electrolysis is carried out by passing an electric current through the olefinic compound in contact with a cathode and in the presence of carbon dioxide. The olefinic compound or medium in which it is employed must have sufficient conductivity to conduct the electrolysis current. It is preferable from an economic viewpoint not to have too high a resistance. The required conductivity is generally achieved by employing common supporting electrolytes, such as electrolyte salts of sufficiently negative discharge potentials.

The present reaction is preferably effected in the presence of a solvent for the olefin and the electrolyte. The electrolyte salts may not be readily soluble in the olefins. In addition, the solvents may be useful as diluents in order to obtain desired ratios of reactants. Carbon dioxide at atmospheric pressure has only limited solubility in most of the olefins and solvents employed herein.

Since the desired reaction involves a dimerization of the olefinic reactant, it is generally desirable to have a considerable excess of the olefinic reactant over the carbon dioxide. However, when the reaction is one controlled by cathode potential to effect an initial uptake of only one electron, as discussed herein, the control of concentrations is not necessary to direct the process toward the carboxylated dimer, as the carboxylated dimer is obtained even at very low concentrations of the olefinic reactant. The concentrations can be utilized as a method of control, as an alternate to, or in addition to, cathode potential, employing a concentration of olefinic reactant sufficiently high to direct the reaction toward the production of carboxylated dimer, for example, sufficiently high to produce more carboxylated dimer than carboxylated monomer. Catholytes can desirably, for example, contain at least 10 times as much olefinic reactant as carbon dioxide, on a molar basis. For reactions employing solutions saturated with carbon dioxide at ambient conditions, this may require solutions of at least 1 molar concentration in olefinic reactant. In the event fairly high conversions of reactant are contemplated in a particular procedure, it may be desirable to add additional increments of reactant in order to maintain concentrations above the desired level. In general relatively high concentrations of olefinic reactant can be employed in the present process, up to 70 or 80%, by weight, of the catholyte, or perhaps constituting the entire catholyte other than the supporting electrolyte. There should, however, be a sufficient concentration of the carbon dioxide, relative to the olefinic reactant, to produce the desired carboxylated product, rather than permitting polymerization of the olefinic reactant to higher molecular weight products. Ordinarily, this will not be an important consideration and the concentrations can be readily adjusted by lowering the olefinic concentration or by employing carbon dioxide under pressure. Moreover, the concomitant production of some carboxylated polymer can be tolerated, and while detracting from the yield of carboxylated dimer, the carboxylated polymer should be expected to have similar properties and to be useful in similar applications, particularly lower polymers or oligomers, such as trimers, pentamers, etc. In fact it may at times, be desirable to employ modifications of the present process directed toward production of carboxylated oligomers and polymers.

It will generally be desirable for the solvents to have a fairly high dielectric constant in order to lower electrical resistance. Of course, the choice and concentration of electrolyte salts can also be used to lower electrical resistance. Solvents desirable of use herein include, for example, dimethylformamide, acetonitrile, hexamethylphosphoramide, dimethylsulfoxide, etc. In general, it is desirable to employ a solvent with a dielectric constant of at least 25, and preferably of at least 50. Many of the useful solvents can be characterized as aprotic, and such solvents can suitably be utilized, particularly those of dipolar character which exhibit high dielectric constants. As discussed herein, the protonation, or lack of protonation, of intermediates has an effect upon the products produced in the present invention. Protons can convert the added carboxyl groups to free acids. A proton source may affect the yield of dimer product, but its presence to some extent, can be tolerated. However, virtually aprotic and nearly anhydrous solvents will generally be used.

In the present process, it is generally desirable to have the electrolyte, olefinic reactant and solvent in a fairly homogeneous dispersion. A true solution is not required as, for example, many quaternary ammonium salt solutions may, in some respects, be dispersions rather than true solutions. Thus the present invention may use emulsions as well as true solutions. Moreover in emulsions or media having more than one phase, electrolysis can occur in a solution of the components in one of the phases.

With the electrolyte and solvent materials usually employed, the catholyte will generally be approximately neutral, so far as acidity-bascity is concerned, and no particular provisions are necessary to regulate this parameter. However, it will usually be desirable to operate under near neutral conditions in order to avoid possibly promoting hydrolytic or other side reactions, or protonation of intermediates. Solubility and stability considerations with respect to the olefins and carboxylated products may also be relevant to selection of desirable pH values. In long term continuous reactions with re-use of catholyte media, it may be desirable to use buffers or to adjust pH periodically to desired values.

In carrying out the present process, a supporting electrolyte is generally used to enhance conductivity. With some combinations of activated olefins and solvents, an additional electrolyte may not actually be necessary, but in practice, a supporting electrolyte is utilized in the present invention. A supporting electrolyte, as understood by those in the art, is an electrolyte capable of carrying current, but not discharging under the electrolysis conditions. In the present invention, this primarily concerns discharge at the cathode, as the desired reaction occurs at the cathode. Thus the electrolytes employed will generally have cations of more negative cathodic discharge potentials than the discharge potential of the olefinic compound. An electrolyte with a similar or slightly lower discharge potential than the olefinic compound may be operative to some extent, but yields and current efficiency are adversely affected, so it is generally desirable to avoid any substantial discharge of the electrolyte salt during the electrolysis. It will be recognized that discharge potentials will vary with cathode materials and their surface condition, and various materials in the electrolysis medium, and it is only necessary to have an effective reduction of the olefinic compound under the conditions of the electrolysis, and some salts may be effective supporting electrolytes under such conditions even though nominally of less negative discharge potential than the olefin employed.

In general, any supporting electrolyte salts can be utilized in effecting the present process, with due consideration to having conditions suitable for the discharge of the olefinic compound involved. The term salt is employed in its generally recognized sense to indicate a compound composed of a cation and an anion, such as produced by reaction of an acid with a base. The salts can be organic, or inorganic, or mixtures of such, and composed of simple cations and anions, or very large complex cations and anions. Amine and quaternary ammonium salts are generally suitable for use herein, as such salts generally have very negative discharge potentials. Certain salts of alkali and alkaline earth metals can also be employed to some extent, although more consideration will have to be given to a proper combination of olefin and salt in order to achieve a discharge. Among the quaternary ammonium salts useful, are the tetraalkylammonium, e.g., tetraethyl or tetramethylammonium, methyltriethylammonium etc., heterocyclic and aralkyl ammonium salts, e.g., benzyltrimethylammonium, etc. Various anions can be used with the foregoing and other cations, e.g. organic and inorganic anions, such as phosphates, halides, sulfates, sulfonates, alkylsulfate, etc. Aromatic sulfonates and similar anions, e.g., p-toluenesulfonates, including those referred to as McKee salts, can be used, as can other hydrotropic salts, although the hydrotropic property may have no particular significance when employed with very low water content. It is desirable to have some material present which is capable of a discharge at the anode, and a small amount of a halide salt is generally suitable for this purpose. A small amount of olefinic hydrocarbon may be present to scavenge the resulting halogen. In general, the salts disclosed in U.S. Pat. No. 3,390,066 of Manuel M. Baizer as suitable for hydrodimerization of certain allyl compounds, can also be employed in the present process, although the solubility considerations for solutions in water there discussed, are not really essential to the present process. The concentration of salts, when used, can vary widely, e.g. from 0.5% to 50% or more by weight, of the electrolysis medium, but suitable concentrations will often be in the range of 1% to 15% by weight, or on a molar basis, often in the range of 0.1 to 1 molar. If it is desired to have all the components in solution, the amount of salt utilized will then be no greater than will dissolve in the electrolysis medium.

In some cases, under some conditions, there may be advantages in using simple salts, such as lithium salts, and results may be comparable to or better than those obtainable with more complex salts. However, for general applicability and suitability at strongly negative discharge conditions, quaternary ammonium salts, or salts which discharge at more negative potential than −2.2 cathodic volts versus the saturated calomel electrode, are preferred. The term quaternary ammonium is used herein in its generally recognized meaning of a cation having four organo radicals substituted on nitrogen.

Various current densities can be employed in the present process. It will be desirable to employ high current densities in order to achieve high use of electrolysis cell capacity, and therefore for production purposes, it will generally be desirable to use as high a density as feasible, taking into consideration, sources and cost of electrical current, resistance of the electrolysis medium, heat dissipation, effect upon yields, etc. Over broad ranges of current density, the density will not greatly affect the yield. While very low densities are operable, suitable ranges for efficient operation will generally be in ranges from a few amperes/square decimeter of cathode surface, up to 10 or 100 or more amperes/square decimeter. It is often advantageous to select the current with proper relationship to the olefin addition rate to react the olefin at the same rate as added and thus to maintain a desired cathode potential.

The present electrolysis can be conducted in the various types of electrolysis cells known to the art. In general, such cells comprise a container made of material capable of resisting action of electrolytes, e.g. glass or plastics, and a cathode and anode, which are electrically connected to sources of electric current. The anode can be of any electrode material, so long as it is relatively inert under the reaction conditions. Ordinarily the anode will have little or no influence on the course of the electrolysis, and can be selected so as to minimize expense and any corrosion, or erosion problem. However, there is a possibility of some interference from oxidation reactions, and this can be minimized by use of anodes other than platinum or carbon, for example by use of stainless steel or lead. Any suitable material can be employed as the cathode, various metals, alloys, graphite, etc. being known to the art. However, the cathode materials can have some effect upon the ease and efficiency of the reaction. For example mercury, cadmium, lead and carbon cathodes are suitable. The half-wave discharge potential of olefinic compounds will vary with the electrode material, and ordinarily the electrolysis will be facilitated by employing electrodes in the lower ranges of discharge potentials. However, it should be noted that performance of the materials can be greatly affected by surface characteristics, alloying, or impurities, e.g. stainless steel give different half-wave potentials than iron.

In the present process, a divided cell will often be employed, i.e., some separator will prevent the free flow of reactants between cathode and anode. Generally the separator is some mechanical barrier which is relatively inert to the electrolyte materials, e.g., a fritted glass filter, glass cloth, asbestos, porous polyvinyl chloride, etc. An ion exchange membrane can also be employed. The desired reactions will occur in an undivided cell, and this could have advantages for industrial production in that electrical resistance across a cell-divider is eliminated.

When a divided cell is used, it will be possible to employ the same electrolysis medium on both the cathode and anode sides, or to employ different media. In some circumstances, it may be advisable to employ a different anolyte, for economy of materials, lower electrical resistance, etc.

The electrolysis cell employed in the procedural Example herein is primarily for laboratory demonstration purposes. Production cells are usually designed with a view to the economics of the process, and characteristically have large electrode surfaces, and short distances between electrodes. The present process is suited to either batch or continuous operations. Continuous opertions can involve recirculation of a flowing electrolyte stream, or streams, between electrodes, with continuous or intermittent sampling of the stream for product removal. Similarly, additional reactants can be added continuously or intermittently, and salt or other electrolyte components can be augmented, replenished, or removed as appropriate. In some cases, it is advantageous to add the olefinic reactant at the rate at which it reacts and to have only a low concentration of such reactant present at any time, i.e., to have a high conversion of the olefinic reactant. Additional description of a suitable cell for continuous operation is set forth in U.S. Pat. No. 3,193,480 of Manuel M. Baizer et al.

The products obtained in the present process can be recovered by a variety of procedures. A chromatographic analysis has been largely used for convenient separation and identification. However, for production purposes, a separation by distillation, extraction, or a combination of such procedures will probably be employed. Distillation can be employed if there is sufficient difference in boiling points of the solvents, reactants, and ester products. Most of the simple esters can be distilled without any extensive thermal decomposition. Most of the esters will tend to be soluble in organic phases, rather than aqueous phases, and extraction with organic solvents, such as n-hexanes or diethyl ether are often suitable. Methylene chloride can similarly be used. Treatment with acids or bases can also be used in separations, with due care being taken to avoid saponification of the ester, and noting that the ester will generally be in the organic phase, while salts of the acids may be in the aqueous phase. Olefinic reactant can be distilled from the catholyte and recycled to the electrolysis in continuous procedures.

The electrolysis can be conducted at ambient temperatures, or at higher or lower temperatures. If volatile materials are utilized, it may be desirable to avoid elevated temperatures so that the volatile reactant will not escape, and various cooling means can be used for this purpose in preference to pressure vessels. Cooling to ambient temperatures may be appropriate, but if desired temperatures down to 0° C. or lower can be employed. The amount of cooling capacity needed for the desired degree of control will depend upon the cell resistance and the electrical current drawn. If desired, cooling can be effected by permitting a component to reflux through a cooling condenser. While broad ranges of temperature are operative, the temperatures do appear to have some effect upon yields. Temperatures less than ambient may often be beneficial, e.g., temperatures of 10° C. to 0° C. or lower. For example, temperatures of −20° C. or lower appear beneficial in the reaction with diethyl maleate. Pressure can be employed to permit electrolysis at higher temperature with volatile reactants, but unnecessary employment of pressure is usually undesirable from an economic standpoint.

The present process involves a carboxylation reaction and therefore requires a source of the $$-\overset{\overset{\displaystyle O}{\|}}{C}-O-\text{ group,}$$

and carbon dioxide admirably serves this purpose. The carbon dioxide can be supplied at atmospheric pressure or at higher pressures, e.g., 50 or 100 atmospheres or more of carbon dioxide. Other sources can also be used, such as alkali metal carbonates, for example sodium bicarbonate, or various other materials equivalent to or a source of carbon dioxide or carbonic acid. The present invention contemplates reactions occurring in the presence of carbon dioxide regardless of its source. In utilizing the carbon dioxide under ambient conditions, there is no need to rigidly exclude other gases from the reaction, and when operating at atmospheric pressure some of the pressure may be due to the partial pressure of other gases present.

The following Example is illustrative of the invention.

EXAMPLE

A typical H-cell was employed in which cathode and anode compartments were separated by a medium porosity glass frit. A mercury cathode (38 $cm^2$ surface area) and platinum anode were employed. As the catholyte medium, initially a 150 ml. electrolyte solution was employed, which was a 0.1 to 0.2 molar solution of tetraethylammonium p-toluenesulfonate, in acetonitrile, and specified amounts of olefinic reactant were added thereto. Dry carbon dioxide was continuously bubbled into the catholyte at atmospheric pressure during the electrolysis. The cathode voltage was controlled by a potentiostat. Results were as follows:

| Olefin | Olefin Addition Rate (gms. 1 hr.) | T(° C) | Cathode Voltage | Current (Amperes) | Product | Current Efficiency |
|---|---|---|---|---|---|---|
| dimethyl maleate | 4.02 a. | −10 to −20° | −1.59 to −1.68 | 0.03 to 0.8 | hexamethyl 1,1,2,3,4,4-butane hexacarboxylate | 46% |
| dimethyl maleate | 0.67 | 10 | −2.07 to −2.1 | 0.04 to 0.4 | tetramethyl 1,1,2,2-ethanetetracarboxylate | 31% |

a. The dimethyl maleate was added initially.

The cathode voltages are versus a saturated calomel electrode. In the first procedure with dimethyl maleate, the dimethylmaleate was added to the solution initially to provide an excess concentration, and the cathode voltage was controlled to provide for a one-electron uptake, thus resulting in dimerization along with carboxylation. Dimethyl maleate had been determined to have -E 1/2 of −1.53 and −1.84 by polarography at $10^{-3}$ molar concentration in presence of $10^{-3}$ molar dissolved carbon dioxide.

The contents of the cathode compartment were treated with methyl iodide to convert the tetraethylammonium carboxylate salts to methyl esters. The esters were separated by gas liquid chromatography and identified by elemental analysis and instrumental methods.

The hexamethyl 1,1,2,3,4,4-butane hexacarboxylate product crystallized from methanol, had a m.p. of 136°–137° C; analysis, for $C_{10}H_{22}O_{12}$, Theory:C, 47.3%, H, 5.42%, Found: C, 47.4%, H, 5.42%. Molecular weight measurements were consistent with the stated molecular formula, and mass spectral analysis also confirmed the structure.

The compound can suitably be used as a detergent builder. Related ester products can be prepared by using other esters of maleic acid as the reactant, and utilizing the corresponding organic iodides for the esterification step, for example electrolyzing diethyl maleate under the same reaction conditions as utilized in the example, and utilizing ethyl iodide for esterification. If desired, mixed esters can be obtained by electrolyzing, for example, diethyl maleate, and esterifying with methyl iodide. The foregoing products can be utilized as detergent builders and for other purposes in the same manner as the hexamethyl product, and various other lower alkyl esters are similarly useful. Similarly, other 2,3-olefinic nitriles, esters, and amides can be utilized in the illustrated procedure, but utilizing higher concentrations of olefinic reactant if the reactant has only a single half-wave potential. Thus any of the specific olefins disclosed herein can be utilized in concentrations at least ten times that of the carbon dioxide on a molar basis to obtain corresponding products. For example, acrylonitrile produces dimethyl 2,5-dicyanoadipate, and methyl acrylate produces tetramethyl 1,1,4,4-butane tetracarboxylate. These products can be employed in the same uses as the other products disclosed herein.

The carboxylated products produced in the present process can be readily interconverted from acid to salt or ester form, etc. The carboxyl function makes the products suitable for various purposes in known manner as intermediates. Many of the products are known compounds of known uses. The products in various forms are suitable as detergent builders and can be modified for such purpose by formation of various salts, or by formation of various esters or polyesters or others through reaction with glycols or other alcohols. Resinous polyesters suitable for coating or fiber forming uses can also be produced by usual ester forming reactions of the carboxyl products, in either ester or free acid form, with polyhydroxy compounds, with difunctional products being appropriate for production of linear polymers, while tri- or greater functionality is useful where crosslinking is desired. The hexacarboxylated butanes of the present invention are useful for the aforesaid purposes and may be particularly suitable as detergent builders.

What is claimed is:

1. The method of electrolytic carboxylation and dimerization of alpha, beta-olefinic nitriles, esters and amides which comprises effecting electrolytic reduction at the cathode in an electrolysis medium comprising such olefinic compound, solvent, supporting electrolyte and carbon dioxide, with the concentration of the carbon dioxide with respect to the olefinic compound not being sufficient to prevent substantial dimerization, and causing production and recovery of a carboxylated dimer of the olefinic compound.

2. The method of claim 1 in which the compound is a maleate.

3. The method of claim 1 in which the compound is a fumarate.

4. The method of claim in which the olefinic compound is present in an amount at least 10 times that of carbon dioxide on a molar basis.

5. The method of claim 4 in which the process is conducted in an aprotic solvent.

6. The method of claim 1 in which the olefinic compound is an alkyl ester of an $\alpha,\beta$-olefinic carboxylic acid and the product is a 1,1,4,4-tetracarboxylated butane.

7. The method of claim 1 in which the olefinic compound exhibits two polarographic half-wave potentials in the presence of carbon dioxide, and the electrolysis is effected at a potential causing initial addition of a single electron to such olefinic compound.

8. The method of claim 7 in which an aprotic solvent is used with a quaternary ammonium salt electrolyte.

9. The method of claim 8 in which the olefinic compound is a maleate.

10. The method of claim 9 in which the electrolysis is carried out at atmospheric pressure with addition of gaseous carbon dioxide and at a temperature less than 0° C.

11. The process of claim 1 in which the olefinic compound is an alkenyl nitrile, ester, or amide.

12. The process of claim 11 in which the solvent is a substantially anhydrous aprotic solvent with dielectric constant of at least 50 and the supporting electrolyte is a quaternary ammonium salt.

13. The process of claim 11 in which the solvent is acetonitrile.

14. The process of claim 11 in which the solvent is dimethylformamide.

* * * * *